United States Patent [19]

Zelnick

[11] 4,388,796

[45] Jun. 21, 1983

[54] STRETCH WRAP SYSTEM AND METHOD OF PACKAGING

[75] Inventor: Seymour Zelnick, Bridgewater, N.J.

[73] Assignee: Weldotron Corporation, Piscataway, N.J.

[21] Appl. No.: 196,852

[22] Filed: Oct. 14, 1980

[51] Int. Cl.[3] ..... B65B 11/02

[52] U.S. Cl. ..... 53/441; 53/466; 53/556; 53/218; 53/222; 53/390

[58] Field of Search ..... 53/441, 463, 466, 556, 53/590, 218, 219, 222, 390

[56] References Cited

U.S. PATENT DOCUMENTS

| | | | |
|---|---|---|---|
| 2,006,116 | 6/1935 | Schmiedel | 53/590 |
| 2,991,600 | 7/1961 | Lancaster | 53/556 |
| 3,496,700 | 2/1970 | McCabe | 53/390 |
| 3,517,479 | 6/1970 | Pinkham | 53/550 |
| 3,546,836 | 12/1970 | Buob | 53/219 |
| 3,662,513 | 5/1972 | Fabbri | 53/226 X |
| 3,777,452 | 12/1973 | Koenders | 51/206 |
| 3,967,433 | 7/1976 | Bonfiglioli | 53/228 X |
| 3,973,372 | 8/1976 | Omori | 353/441 |
| 3,977,158 | 8/1976 | Jennings et al. | 53/226 |
| 4,078,363 | 3/1978 | Ranzi | 53/228 |
| 4,144,697 | 3/1979 | Suga | 53/556 |
| 4,178,740 | 12/1979 | Groome et al. | 53/556 |

FOREIGN PATENT DOCUMENTS

| | | | |
|---|---|---|---|
| 2745933 | 4/1978 | Fed. Rep. of Germany | 53/209 |
| 2410601 | 6/1979 | France | 53/556 |

*Primary Examiner*—John Sipos

*Attorney, Agent, or Firm*—Davis, Hoxie, Faithfull & Hapgood

[57] ABSTRACT

The disclosure concerns an apparatus and method for wrapping products in stretch film by placing each product on a product support table having collapsible fingers. A pivotable frame is loaded with successive lengths of stretch film and pivoted down over each product placed on the support table. Tucking blades mounted on the frame tuck the side edges of the film under the product, while infeed and outfeed rollers tuck the front and back edges under the product. Pusher means then advance the product onto the outfeed conveyor to complete the front tuck and seal the film beneath the product.

37 Claims, 8 Drawing Figures

Fig. 5.
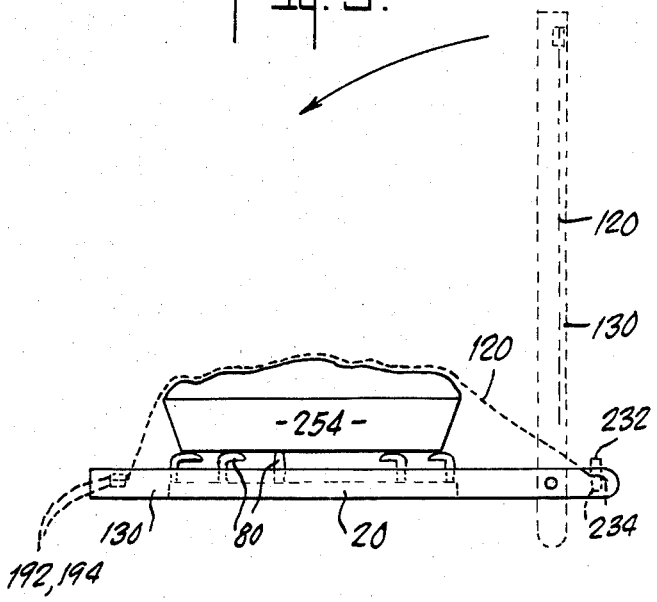
Fig. 6.
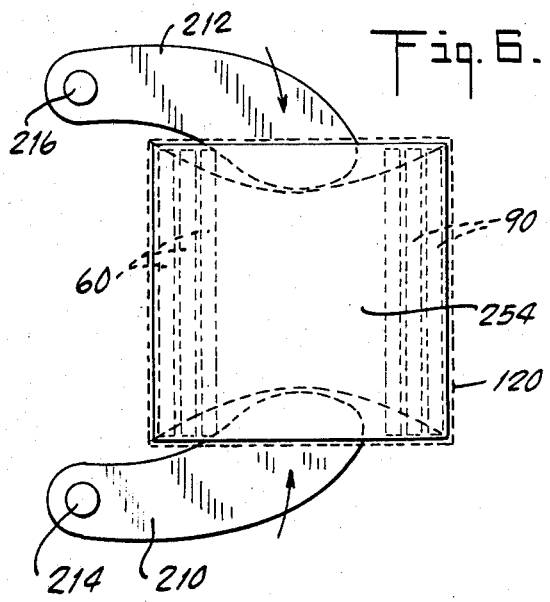
Fig. 4.
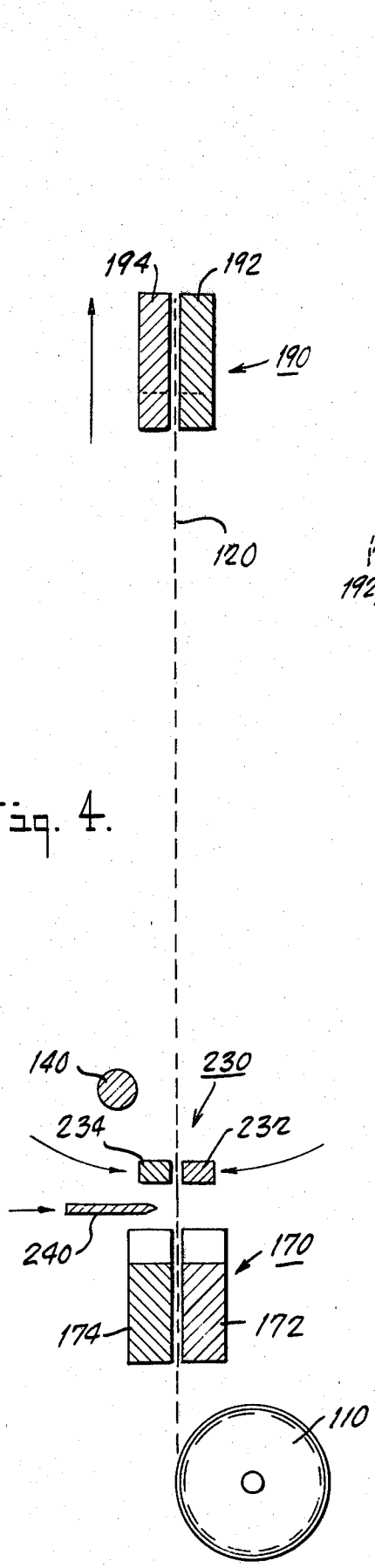
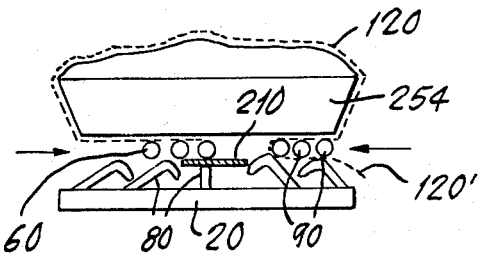
Fig. 7.

STRETCH WRAP SYSTEM AND METHOD OF PACKAGING

This invention relates to the field of packaging, and, more particularly, to packaging by stretch wrapping.

SUMMARY OF THE INVENTION

Stretch wrapping is a packaging technique, especially for trayed products, wherein stretchable plastic film is stretched around a product so as to produce a tightly conforming wrapped package. It is especially popular today, since, unlike shrink packaging, it does not require subsequent exposure to heat in a large and expensive and energy-consuming oven after the wrapping operation, to produce the final package. This technique has been used for several years, primarily in supermarkets, with the wrap performed manually. Now, with the availability of high-speed automatic equipment, the technique is finding ever-widening applications.

Fabbri U.S. Pat. No. 3,622,513 discloses automatic equipment for stretch wrapping trayed products which is generally satisfactory. However, the equipment is relatively complex and expensive, requiring elevator apparatus to elevate the trayed product into the wrapping film, to stretch the film, and folding members to fold the film around the trayed product while it is in an elevated position.

These disadvantages are overcome by the present invention, and simpler and less expensive apparatus is achieved, by maintaining the trayed product in a single plane and using a simple pivotal motion to effect the stretch wrap.

BRIEF DESCRIPTION OF THE DRAWINGS

FIG. 4 is a side sectional diagramatic view of the film feeding clamps of the apparatus of FIG. 1;

FIG. 5 is a side sectional diagramatic view of the film holding frame and product support table of the apparatus of FIG. 1, illustrating the pivotal operation of the frame to achieve stretch wrapping of the product;

FIG. 6 is a fragmentary plan view of the tray on the support table of FIG. 1, illustrating the side tucking blades during the wrapping operation; and FIG. 7 is a side view of the tray and the product support table of FIG. 1, illustrating the tucking operation produced by the infeed and outfeed rollers.

DETAILED DESCRIPTION

Figure 1:
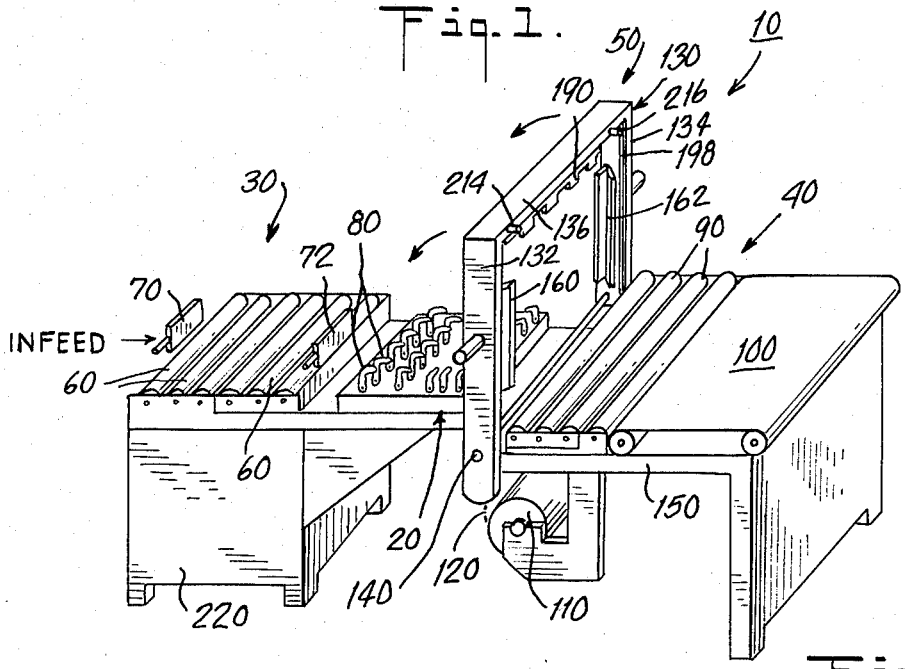
FIG. 1 is a perspective view of apparatus embodying the invention.

Referring to FIG. 1, the apparatus 10 of the invention includes a fixed product support table 20, an infeed conveyor 30 adjacent the rear of the support table, and outfeed conveyor 40 adjacent the front end of the support table, and a film handling apparatus 50 between the support table and the outfeed conveyor.

The infeed conveyor 30 comprises a plurality of horizontal, parallel rollers 60 and two associated pusher arms 70 and 72 for pushing a trayed product along the conveyor rollers 60 onto the support table 20, and from the support table to the outfeed conveyor 40, as will be discussed.

Figure 1A:
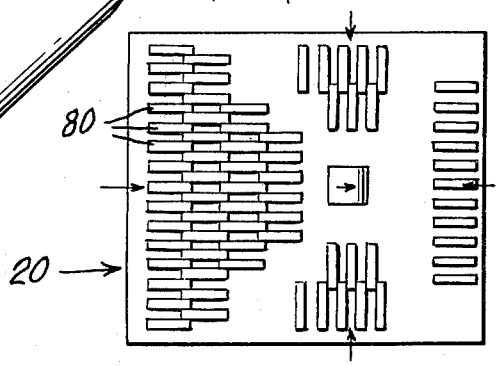
FIG. 1*a* is a plan view of the product support table 20 of FIG. 1.

The support table 20 includes a plurality of spring-loaded pivotable support blades or fingers 80 of the type disclosed in Fabbri U.S. Pat. No. 3,622,513, which is incorporated herein by reference. As discussed in this Fabbri patent, fingers 80 are maintained generally upright, to support the trayed product to be wrapped, as shown in FIG. 5, but they are pivotable in the direction of movement of the folding or tucking members, so that they are pivoted downward by such members, to permit the tucking members to tuck the film under the tray, as shown in FIGS. 6 and 7. A plan view of the layout of the fingers 80 on the table 20 is shown in FIG. 1*a*. While the folding or tucking members are beneath the tray, they take over the product support function of the fingers they have pivoted downward, to assist in supporting the trayed product.

The outfeed conveyor comprises a plurality of parallel driver rollers 90, and, at the right-hand output end thereof, a low-temperature heat sealing belt 100.

Beneath the outfeed conveyor 40 and film-handling apparatus 50, is a horizontally disposed roll 110 of wrapping film 120, which is suitably supported. This film is preferably polyvinyl chloride stretch film, although it can be any commercially available stretch film. A second roll may also be provided, having film of a different width than the film on roll 110, with manual or automatic selection between the two rolls, so that the apparatus can accommodate trayed products of a wide range of sizes.

The film-handling apparatus 50 is disposed between the support table 20 and the outfeed conveyor 40. It includes a generally rectangular frame 130, which includes side arms 132, 134 and an upper cross arm 136. The frame 10 extends vertically upwardly in its rest position, as shown in FIG. 1, or at some angle with the horizontal plane of the infeed and outfeed conveyors, such as 45 degrees, that will clear the heights of the trayed products over the range of products to be wrapped. The term upright will at times by used to signify the rest position of frame 130, and it should be understood that this signifies an angular position of frame 130 away from table 20, but not necessarily vertical. Frame 130 is pivotally secured to rod 140 at the lower ends of its side arms, rod 140 being mounted in frame 150 of the outfeed conveyor. The pivotal movement of the frame 130, by any suitable means is rearward as shown in FIG. 5.

A pair of side film clamps 160 and 162 are mounted on side arms 132 and 134 of the frame 130 and are adapted to slide toward and away from each other.

Figure 2:
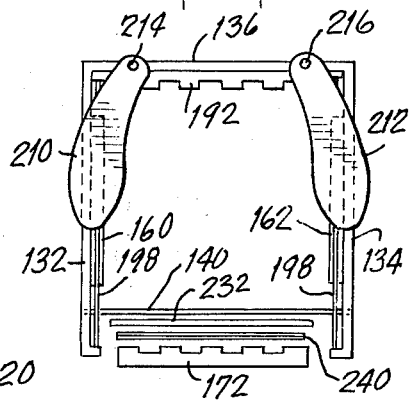
FIG. 2 is an elevational view of the film handling apparatus of FIG. 1 with the side tucking blades in place.
Figure 3:
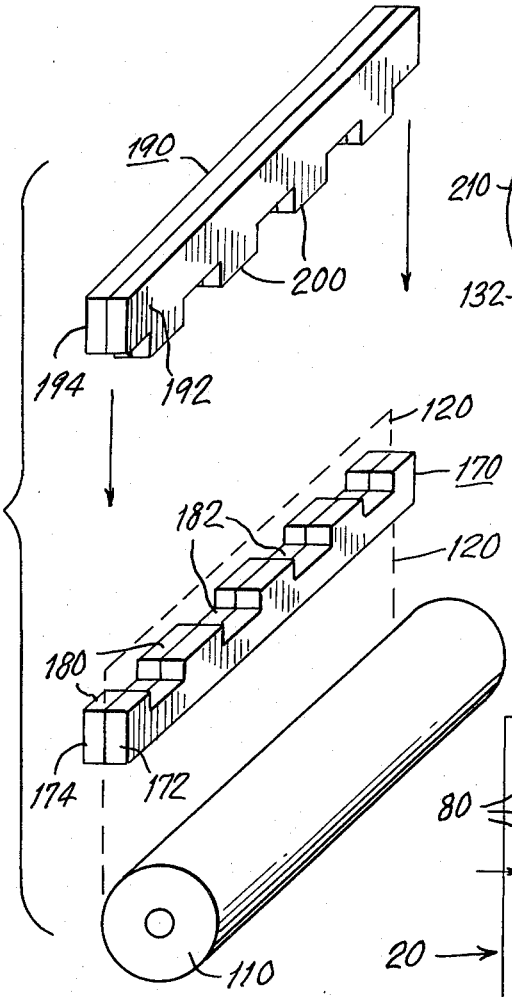
FIG. 3 is a perspective view of the film feeding clamps of the apparatus of FIG. 1.

A pair of plates 172, 174, which have been omitted from FIG. 1 for purposes of clarity, but shown in FIGS. 2 and 3, form a lower film clamp 170. This clamp, which can also be a roller clamp, is fixed to the frame 150 of the output conveyor, above and parallel to the film roll 110. The plates 172, 174 are adapted to clasp the leading end of the film 120, and the leading edges of these plates are notched or segmented to provide "teeth" 180, which expose the leading end of the film in the notches 182 between the teeth.

A similar segmented upper clamp 190 is formed by a pair of plates 192, 194, which can be opened and closed with respect to each other, and are segmented along their lower edges to form teeth 200 which mesh with the notches 182 of the fixed plates 172, 174. The clamp 190 is mounted on frame 130 to be slideable toward and away from lower clamp 170, such as by the use of rods 198.

Two pivoting side tucking blades 210, 212 are suitably mounted on the frame 130 to be pivotally movable. These blades can be mounted on pins 214, 216, as shown in FIG. 2, and suitable means included for pivoting the lower ends of the blades inward to tuck the film under the trayed product, as will be explained. Pins 214, 216 have been shown in FIG. 1, but the blades have been omitted from that figure for purposes of clarity. Similar tucking blades are disclosed in the Fabbri patent which has been incorporated herein by reference.

Before discussing the operation of apparatus 10, it will be well to discuss the pushers 70 and 72 and their operation in greater detail.

These pushers are carried by a conveyor mechanism (not shown) which is located along the side of the input conveyor 30 and product table 20. The conveyor mechanism operates to move the pushers 70 and 72 forward and, thereafter, to return them to their left-most positions shown in FIG. 1.

When pusher 72 moves forward, it pushes any trayed product on the product support table 20 onto the driven rollers 90 of the outfeed conveyor. This occurs while the product is resting on the right-most rollers 60 of the infeed conveyor and the left-most rollers 90 of the outfeed conveyor, after these rollers have moved toward each other to be located under the trayed product, as shown in FIG. 7. Once the product has been pushed to the outfeed conveyor, or while this is occurring, the left-most rollers 90 return rightward to their position shown in FIG. 1. Also, the right-most rollers 60 are turned leftward to their position shown in FIG. 1. Pusher 70 then pushes any trayed product on infeed conveyor 30 onto the product support table 20.

Suitable guide means may be employed to facilitate placing and maintaining the trayed product in proper alignment on the infeed conveyor 30 and support table 20.

Pusher 72 has a retract mechanism (not shown) of known type, such that after pushing a product from table 20 to the outfeed conveyor 40, this pusher will return to its left-most position shown in FIG. 1 and retract downwardly, or rotate 90 degrees to be flat, to provide clearance for pusher 70 to push the next trayed product onto table 20.

The return or leftward movement of pusher 72 occurs while the right-most rollers 60 are returning leftward to their initial position. This return of pusher 72 to its left-most position allows the frame 130 to return to an upright state, so that frame 130 can advantageously be loaded with film while pusher 70 is pushing the next trayed product onto table 20.

Other pusher arrangements can also be employed, such as an overhead conveyor system carrying one or two pusher members, so long as the overhead conveyor leaves clearance for the pivotal movement of frame 130.

The operation of the apparatus 10 includes product feeding, film feeding, and wrapping. The operation of these three functions can be considered separately and then their relationship to one another discussed.

The product feeding function involves placing a product 254 (shown in FIGS. 5 to 7) on the rollers 60 of the infeed conveyor 30, either manually or by a conveyor which can be synchronized with the intermittent feed of the products through apparatus 10. The presence of the product on rollers 60 is sensed by a microswitch, and when the wrapping operation of the preceding trayed product has been completed, and frame 130 returned to its upright position, pusher 70 is actuated to advance the product onto table 20. Thereafter, as will be discussed, the wrapped product is pushed from table 20 by pusher 72 onto the rollers 90 of the outfeed conveyor.

The film feeding function begins with the free end of the film 120 held between plates 172, 174 of the lower clamp 170. See, e.g., FIG. 3. The sliding plates 192, 194 of the upper clamp 190 move downwardly to the lower clamp 170, being open as they approach plates 172, 174 to receive the leading end of the film. The teeth 200 on the sliding clamp 190 mesh with the notches 182 on the fixed clamp 170, to grasp the film. Clamp 190 then returns toward the top of the pivoting frame 130, and stops at a point which is preset as a function of tray size.

During most of the upward movement of clamp 190, the plates of the lower clamp 170 are open to permit the free movement of the film. Also, a film feeding assist can be employed to advance the film roll 110, and an intermediate film buffering section, to avoid any undue tension in the film. When the preset point is reached by clamp 190, however, clamp 170 closes. Moreover, if a longitudinal prestretch of the film is desired, clamp 170 is advantageously closed at a predetermined point of the upward movement of clamp 190, before its upper stopping point is reached, to achieve the desired prestretch. Alternatively, a longitudinal prestretch can be achieved by maintaining a predetermined constant clamping pressure on clamp 170 while the sliding clamp 190 is moving upward, the constant clamping pressure being selected to produce the desired amount of prestretch, while not totally restricting the forward movement of the film through the clamp 170.

When the sliding clamp 190 has reached its upper stopping point, plates 232, 234 of an auxiliary clamp 230, shown in FIG. 4, move together and clamp the lower end of the film just above the clamp 170. The film is then severed below clamp 230 by knife 240, although the film severing can take place at any time before, or during, the end tucking operation to be described. Clamp 230 is preferably mounted on frame 130, to pivot with the frame. Also, it is preferably a pivot clamp, which pivots into closed and open positions, but it can also be a linear clamp.

With the film in frame 130, between the upper clamp 190 and the auxiliary clamp 230, side clamps 160, 162 move inwardly from the side arms 132, 134 of frame 130 to clamp the vertical edges of the film. They then preferably retract, to prestretch the film in a lateral direction.

The wrapping function begins once frame 130 has been loaded with film in this manner. This involves pivoting the frame 130 downward to a horizontal position, over the product, as shown in FIG. 5, to stretch the film over the product. The horizontal position of frame 130 brings the film sufficiently below the bottom of the tray 254 to leave room for the folding and tucking members, as also shown in FIG. 5.

The side tucking blades 210, 212 carried on frame 130 have been omitted from FIG. 5, to avoid cluttering the drawing. When frame 130 is horizontal, these tucking blades are above its upper surface, just below the infeed and outfeed rollers 60 and 90. The tucking blades pivot inwardly to tuck the film under the tray on each side, causing the springloaded fingers 80 in their paths to pivot inwardly to make room for the blades. The blades move inwardly about one-third of the width of the trayed product, but the extent of their inward movement is not critical. Indeed, the apparatus 10 will wrap trays having a range of sizes, even without adjusting the extent of movement of the various members, and, as the tray size varies, the percentage of the tray width covered by the inward movement of the tucking blades will also vary.

At the same time the side tucks are being made, by blades 210, 212, a segment of the infeed and outfeed rollers 60 and 90, formed by the last three rollers 60 and the first three rollers 90, move under the tray 254, to tuck the trailing and leading edges of the film under the tray. These rollers also cause certain of the spring-loaded fingers 80 to pivot inwardly, so that the rollers can move beneath the tray, and rollers 60 also pass over the tucking blades 210, 212, and over the fingers 80 that have been depressed by those blades.

The extent of the inward movement of the rollers is also not critical. For long packages 254, the infeed rollers 60 generally continue inward until they have played out the length of film they are carrying, while for shorter packages this may not be true, and there may be some fold-back of the film carried by rollers 60. Since this occurs under the tray, it does not significantly affect the appearance of the film wrap, and it is consequently considered acceptable. The outfeed rollers, on the other hand, do not play out the length of film they are carrying, since this length will be tucked further under the tray when the tray is subsequently being pushed onto the outfeed conveyor, as will be discussed. The infeed rollers 60 can move inwardly at least half the length of the tray, while the outfeed rollers 90 move inwardly only a sufficient distance to support the forward end of the tray, as shown in FIG. 7, so that the infeed and outfeed rollers do not touch.

When the tucking operation begins, with the inward movement of side tucking blades 210, 212 and rollers 60 and 90, the film is being held clamped by the end clamps 190 and 230 and the side clamps 160 and 162. If the tucking members contacted the film while it is held tightly clamped, they would tear it. Therefore, at a predetermined instant, just before the tucking members begin their inward movement, the clamping pressure of the clamps 160, 162, 190 and 230 is reduced, to permit the film to be folded under the tray. Since the film is in a stretched condition, the reduction of the clamping pressure generally releases the film and permits its edges to withdraw inwardly. The rapidly moving tucking members then catch the released film, before its edges have withdrawn sufficiently to be beyond the paths of these members, to produce the tucking of the edges under the tray. Because of the tackiness of the film it will adhere to the bottom of the tray 254, at least sufficiently to facilitate the remainder of the wrapping operation.

Once the rollers 60 and 90 have reached their innermost positions, such as shown in FIG. 7, pusher 72 advances rightward to push the trayed product further onto the rollers 90 of output conveyor 40. As already noted, this serves to tuck the forward end 120' of the film, shown in FIG. 7, under the tray, to overlap the side and end tucks at the other edges of the tray, and complete the wrapping operation. The powered discharge rollers 90 then discharge the package onto heat-seal belt 100 to form a seal between the overlapped edges of the film beneath the tray.

While the product is being pushed onto the outfeed conveyor, the left-most rollers 90 are returned to their initial position as part of the outfeed conveyor. Also, rollers 60 can move rightward a short distance to ensure support of the product. If the rightward movement of rollers 60 includes passing them over the right-most fingers 80, which have been depressed by rollers 90, such as might be the case if short product trays are being wrapped, a latch mechanism can be employed to hold down the right-most fingers 80, after they have been depressed by rollers 90, until all of the other fingers 80 have been released to return to an upright position.

Once the tray 254 has been pushed rightwardly beyond the underlying rollers 60, these rollers return to their initial position as part of the infeed conveyor, as shown in FIG. 1. Also, pusher 72 returns to its left-most position, and tucking blades 210, 212 pivot outwardly to their initial positions.

Frame 130 then pivots upward to return to its rest position, to be loaded with another sheet of film while pusher 70 pushes the next product onto table 20 for wrapping. As already noted pusher 72 is retracted or rotated downward to be out of the path of pusher 70 and the new product.

The entire cycle is then repeated for each successive product to be wrapped.

While this explanation separates the product feeding, film feeding and wrapping functions, for purposes of explanation, it will be appreciated that all of these functions form a part of the wrapping process.

It should also be understood that these various functions are not necessarily synchronous, but in a high-speed wrapping line they will be performed synchronously.

Thus, where only occasional products are to be wrapped the frame 130 can be loaded with film in the manner discussed, and it can then await the presence of a product on the support table 20, whereupon the wrapping process is begun. Alternatively, the presence of a package on support table 20 can be sensed to initiate the loading of film into frame 130 and the subsequent wrapping process.

In high-speed wrapping, however, the sequence of operation is as follows. Assume a point in the sequence where the frame 130 is in an upright position, and a trayed product is present on the infeed conveyor. The wrapping sequence involves the following: (1) pusher 70 pushes the trayed product onto table 20, while frame 130 is being loaded with film in the manner discussed, which preferably includes the prestretch operations explained; (2) frame 130 then pivots downward and the wrapping operation takes place, including the side tucking by blades 210, 212, and the end tucking by the innermost rollers 60 and 90; (3) pusher 72 then pushes the product onto the outfeed conveyor and returns and retracts, while the rollers 60 and 90 and tucker blades 210, 212 return to their initial positions; and (4) the frame 130 returns to its initial position to be reloaded with film. The steps (1) to (4) are again repeated as each successive product is wrapped.

The loading of each trayed product onto the infeed conveyor 30 occurs between step (1) in one sequence, when the product has been advanced from the input conveyor to the table 20, and step (1) of the next sequence, when a new product is to be advanced onto table 20.

While the location and operation of the various elements of the apparatus 10 may be understood from the foregoing description, it may be well to particularize as to the specific location of certain of the elements.

With regard to the tucking blades 210, 212, as already noted, these blades are so located on frame 130, and frame 130 so dimensioned, that when frame 130 is pivoted downward to a horizontal position, in step (2) above, the blades will be in a horizontal plane below the tray 254, leaving space below the tray for the infeed rollers 60, which pass between the tucking blades and the tray.

The upper surface of the rollers 60 and 90 are approximately level with the upper surfaces of fingers 80 when the latter are upright, but preferably slightly below that level, by about 1/32", to avoid crushing the tray 254 when the rollers 60 and 90 move inwardly.

With regard to the clamps 160, 162, 170, 190 and 230 associated with frame 130, when the pivot axis of frame 130 is formed by a long rod 140, as shown in FIG. 1, these clamps are slightly offset from the pivot axis, to permit the film 120 to clear rod 140, as shown in FIG. 4.

Further, while the clamp 230 is shown below the rod 140, it could also be above this rod, and still rotate with frame 130. Indeed, if two short stud rods are employed, in place of rod 140, the clamp 230 can be located in line with the axis of rotation of frame 130 but it is still preferable to have this clamp rotate about its own axis as frame 130 rotates.

While the product support table 20 is shown spaced from the infeed and outfeed conveyors 30 and 40, it can actually extend up to or over rod 140 and approach very close to the output conveyor, leaving just sufficient space for the unimpeded passage of the film to the clamp 230 when frame 130 is horizontal. Greater space is needed, however, between the infeed conveyor 30 and table 20, to allow for the passage of the top bar 136 of frame 130 and the slideable clamp 190. If this space presents an obstruction to the smooth transfer of a trayed product from the infeed conveyor to table 20, the space can employ a smooth metal sheet, such as stainless steel, spanning the space between the infeed conveyor and table, and substantially coplanar with the product supporting surfaces of both. The plate will be spring biased upwardly to its coplanar position, and locked in place except when the frame 130 is pivoting downward. Thus, the sheet will be depressed downwardly by frame 130, and it will return to its coplanar position, and be locked in place, when the frame 130 rises.

An alternative construction to that described involves positioning frame 130 and the associated clamps 160, 162, 170, 190, and 230 between the infeed conveyor 30 and support table 20, with the film supply moved to a location beneath the infeed conveyor. In this embodiment the frame 130 pivots forward, and its cross bar 136 and upper clamp 190 will pass into the space between table 20 and the outfeed conveyor 40. In this embodiment, the pushers 70 and 72 can be those described or they can be mounted from the bottom by vertical support arms connected to a drive mechanism, and the infeed conveyor 30 and support table 20 slotted centrally to accommodate the forward movement of these support arm. The pushers 70 and 72 would have a pop-up and retract mechanism (not shown) of known type, such that prior to their forward motion the pushers are in a retracted state below the rollers 60. When their drive conveyor initiates a forward movement, the pop-out mechanism causes the pushers to pop up into the positions shown in FIG. 1. Forward movement of pusher 72 would move any trayed product on table 20 onto rollers 90, and subsequent forward movement of pusher 70, after the innermost rollers 60 and 90 had returned to their initial positions, would move any trayed product on rollers 60 onto table 20.

At the end of their forward movement, when the drive mechanism initiates a rearward movement, the retract mechanism causes the pushers to retract downwardly, and they then move rearwardly in a lowered or retracted state. Transverse slots (not shown) are located at the left-most and right-most positions of the pushers 70 and 72, to accommodate the upward and downward movement of the pushers at those locations. Also, a longitudinal passage at least as large as the pushers is present below the rollers 60 and table 20, to accommodate the rearward movement of the pushers in a lowered state.

The wrapping sequence of this alternate embodiment is essentially the same as the sequence already explained. The principal difference is that with the frame 130 between the infeed conveyor and product support table, the frame cannot be loaded with film concurrently with the advance of the product to the support table. Thus, the step of loading frame 130 with film follows the step of advancing the product to table 20. Also, the return of the pushers 70 and 72 from their right-most positions to their left-most positions can occur in the sequence described or both of these pushers can return simultaneously, after pusher 70 has reached its right-most position.

While apparatus 10 can be one composite machine, it can also be formed of modular units. Thus, infeed conveyor 30, product support table 20 and outfeed conveyor 40 can be three separate units. In this event the infeed or outfeed conveyor can be used for other purposes, or with product support tables of different sizes. Alternatively, the infeed conveyor and product support table can be a single unit, and the outfeed conveyor a separate unit, or the product support table can be integral with the outfeed conveyor.

Other changes and variations will occur to those skilled in the art in view of the foregoing discussion, and it is intended that those changes and variations be encompassed so long as the thrust of this invention is employed, as defined by the following claims.

What is claimed is:

1. A method for stretch wrapping a product comprising loading a product onto a support surface, mounting a frame along a substantially horizontal pivot axis adjacent the product support surface, said frame having slidably movable film clamping means adapted to grasp the end of a length of stretch film, loading stretch film into said frame by moving said film clamping means to draw said length of stretch film across said frame while said frame is being maintained at a substantially upright position, and maintaining it clamped in a sheet-like condition in said frame, pivoting said frame downwardly from its substantially upright position to a substantially horizontal plane over a product positioned on the product support surface to stretch the film in the frame over the product, releasing the clamped film from the frame to allow its edges to withdraw toward said product, and tucking the edges of the film under the product as the film is being released from a clamped condition in the frame.

2. The method of claim 1 further including the step of pre-stretching the film in the frame before the frame is moved over the product to be wrapped.

3. The method of claim 2 wherein the step of pre-stretching the film in the frame includes pre-stretching the film in a longitudinal direction as it is being loaded into the frame, pre-stretching the film in a lateral direction after it has been loaded into the frame, and maintaining the film in a pre-stretched condition as it is lowered over the product.

4. The method of claim 3 wherein the step of loading the film into the frame includes loading the film into the frame while the frame is being maintained in an upright state, and the step of pivoting the frame involves pivoting it from its upright state to a substantially horizontal plane.

5. The method of claim 1 further including the step of moving the wrapped product from the support surface onto an adjoining surface, after said tucking step, to complete the tucking of one edge of the stretch film under the product.

6. The method of claim 5 wherein the step of loading the product onto the product support surface and the step of moving the product from the product support surface to an adjoining surface comprise moving the product along a single plane.

7. A method for stretch wrapping a product comprising loading a product onto a support surface, mounting a frame along a substantially horizontal pivot axis adjacent the product support surface, said frame having slidably movable film clamping means adapted to grasp the end of a length of stretch film, drawing stretch film into a frame in said sheet-like condition by moving said film clamping means to draw said length of stretch film across said frame while said frame is being maintained at a substantially upright position, clamping the sheet-like film about its periphery by the surrounding members of the frame, pivoting said frame downwardly from its substantially upright position to a substantially horizontal plane over a product positioned on the product support surface until the surrounding members of the frame surround the product support surface, to stretch the film in the frame over the product, and releasing said clamping action and tucking the edges of the film under the product while the film is stretched over the product.

8. A method for stretch wrapping a product comprising loading a product onto an infeed station, mounting a frame along a substantially horizontal pivot axis adjacent a product support surface, said frame having slidably movable film clamping means adapted to grasp the end of a length of stretch film, advancing the product from the infeed station to said product support surface for wrapping, and from the product support station to an outfeed conveyor, all along a single plane, loading stretch film into said frame by moving said film clamping means to draw said length of stretch film across said frame while said frame is being maintained at a substantially upright position, and maintaining it clamped in a sheet-like condition in said frame, pivoting said frame downwardly from its substantially upright position to a substantially horizontal plane over the product while it is positioned on the product support surface to stretch the film in the frame over the product, tucking the edges of the film under the product while the film is stretched over the product, and completing said tucking operation while the product is being advanced from the product support surface to the outfeed conveyor.

9. Stretch wrap packaging apparatus comprising a product support table for holding a product while it is being wrapped, an infeed conveyor adjacent to and aligned with said support table for advancing a product onto said support table, an outfeed conveyor disposed adjacent to said support table for receiving a product from said support table, said infeed conveyor, support table, and outfeed conveyor being aligned to define the path of movement of a product, a pivotable film support frame disposed adjacent to said support table, a supply of stretch film, first film-clamping means disposed adjacent to said frame to hold the leading end of said film, second film-clamping means slidably mounted on said frame and slidable into and out of operative relation with said first film-clamping means, clamp moving means for moving said second film-clamping means into operative relation with said first film-clamping means to grasp the end of said film held by said first film-clamping means and draw it across said frame, to load said frame with a sheet of film, third film-clamping means adjacent to the pivot end of said frame adapted to hold the trailing end of said sheet of film loaded into said frame, film-severing means adjacent to said pivot end of said frame, means for pivoting said frame to a substantially horizontal position while it is loaded with a sheet of film to stretch said sheet of film over a product on said support table, first folding means disposed adjacent to the sides of said frame, when the frame is in said substantially horizontal position, said first folding means being operative while said sheet of film is stretched over said product to fold two edges of said sheet of film under the product disposed on said support table, second folding means, operative while said sheet of film is stretched over said product, and disposed adjacent to the front and rear edges of said support table, for folding the front and rear edges of said sheet of film under the product on the support table, and means for advancing the product from the support table to the outfeed conveyor to complete the folding of the front edge of said sheet of film under the product.

10. The apparatus defined in claim 9 wherein said first folding means comprises two blades mounted adjacent to the sides of said frame.

11. The apparatus defined in claim 10 wherein said two blades are mounted on the frame and pivot with the frame.

12. The apparatus defined in claim 11 wherein said two blades are pivotably mounted on said frame, and they are disposed above said frame when it is in a substantially horizontal position.

13. The apparatus defined in claim 12 further including drive means, operative after said frame has reached its substantially horizontal position, and after the clamping pressure of certain of said film clamping means has been reduced, to cause said blades to pivot inwardly to fold edges of said film under the product.

14. The apparatus defined in claim 9 wherein said first folding means comprises two blades disposed adjacent to the opposite sides of said frame, and said second folding means comprises first roller means at the front of said support table and second roller means at the rear of said support table, at least one of said first and second roller means being movable toward the other to tuck at least one edge of the sheet of film under said product.

15. The apparatus defined in claim 14 further including first drive means for causing said two blades to move inwardly against said sheet of film to fold its edges under the product, and second drive means, operative concurrently with said first drive means, for moving at least one of said roller means inwardly to fold at least one additional edge thereof under the product.

16. The apparatus defined in claim 15 wherein said second drive means causes both said first and second roller means to move inwardly to fold opposite edges of said film under the product, and said means for advancing the product from the support table to said outfeed conveyor is operative after said second drive means.

17. The apparatus as defined in claim 9 wherein said film support frame has a pivot axis located between said support table and said outfeed conveyor; and said frame pivots about said axis from an initial position at a substantial angle from the horizontal to a substantially horizontal position.

18. The apparatus as defined in claim 17 wherein said frame has at least a portion thereof located between said support table and said outfeed conveyor when it is in its initial position, and said frame pivots in a backward direction over said support table to stretch the film over a product on the support table.

19. The apparatus defined in claim 9 wherein said frame is substantially rectangular in shape, and includes a cross arm at its upper end and at least two side arms to form said rectangular shape.

20. The apparatus as defined in claim 19 wherein the frame surrounds the support table when it is in its substantially horizontal position.

21. The apparatus defined in claim 9 further including side film-clamping means mounted on said frame, and pivotable with said frame, for clamping the side edges of the film loaded into said frame.

22. The apparatus defined in claim 21 further including means to maintain said side film-clamping means in clamping engagement with the side edges of the sheet of film until said first folding means commences folding the side edges of said film.

23. The apparatus defined in claim 21 wherein said side clamping means are adapted to clamp the side edges of said film and to move toward and away from each other to prestretch said film in a lateral direction before said film is stretched over a product.

24. The apparatus defined in claim 9 wherein said infeed and outfeed conveyors include rollers, and said second folding means includes at least one roller from said infeed conveyor and at least one roller from said outfeed conveyor.

25. The apparatus defined in claim 24 further including pusher means for pushing a product along said infeed conveyor to said support table and from said support table to said outfeed conveyor, said pusher means pushing a product from said support table to said outfeed conveyor while said at least one roller from the outfeed conveyor is moving between said support table and said outfeed conveyor.

26. The apparatus defined in claim 25 wherein said pusher means pushes a product from the infeed conveyor to the support table after said at least one roller from said infeed conveyor has returned from said support table to said infeed conveyor.

27. The apparatus defined in claim 9 wherein said infeed conveyor, package support table and outfeed conveyor define a path of travel for a product which is substantially coplanar from its unwrapped infeed condition to its wrapped outfeed condition.

28. Stretch wrap packaging apparatus comprising a product support table for holding a product while it is being wrapped, an outfeed conveyor disposed adjacent to said support table for receiving a product from said support table, said support table and said outfeed conveyor being aligned to define the path of movement of a product, a pivotable film support frame disposed adjacent to said support table, first film-clamping means disposed adjacent to said frame to hold the leading end of stretch film to be wrapped about the product, second film-clamping means slidably mounted on said frame and slidable into and out of operative relation with said first film-clamping means, clamp moving means for moving said second film-clamping means into operative relation with said first film-clamping means to grasp the end of said film held by said first film-clamping means and draw it across said frame, to load said frame with a sheet of film, means for pivoting said frame, while it is loaded with a sheet of film, to stretch said sheet of film over a product on said support table, first folding means mounted on said frame and pivotable with said frame, said first folding means being operative while said sheet of film is stretched over said product to fold edges of said sheet of film under the product disposed on said support table, second folding means, operative while said sheet of film is stretched over said product, and disposed adjacent to the front and rear edges of said support table for folding the front and rear edges of said sheet of film under the product on the support table, and means for advancing the product from the support table to the outfeed conveyor to complete the folding of one edge of said sheet of film under the product.

29. The apparatus defined in claim 28 wherein said first folding means includes tucking blades pivotally mounted on said frame and moveable inwardly about said pivot mounting to tuck the side edges of the film under the product.

30. The apparatus defined in claim 28 wherein said support frame is substantially rectangular in shape and it surrounds the product support table in its pivoted position.

31. The apparatus defined in claim 30 wherein said frame surrounds the support table, when it is in its pivoted position, to have the tucking blades below the level of, and surrounding, the upper surface of the support table.

32. The apparatus defined in claim 28 further including infeed means to move a product along a single plane to said support table.

33. The apparatus defined in claim 32 wherein the infeed means, the support table and the outfeed conveyor means maintain the product along a single plane.

34. Stretch wrap packaging apparatus comprising a product support surface for holding a product while it is being wrapped, outfeed means having a surface substantially coplanar with and adjacent to said product support surface for receiving a product from said support surface, said support surface and the surface of said outfeed means being aligned to define the path of movement of a product, a pivotable film support frame adjacent to said product support surface, slidable film-clamping means slidably mounted on said frame, clamp moving means for moving said slidable film-clamping means into operative relation with the end of a length of stretch film to grasp said end of said length of stretch film and draw it across said frame, to load said frame with a sheet of said film, means for pivoting said frame, while it is loaded with a sheet of film, to stretch said sheet of film over a product on said support table, first folding means mounted on said frame and pivotable with said frame, said first folding means being operative while said sheet of film is stretched over said product to fold edges of said sheet of film under the product disposed on said support surface, second folding means, operative while said sheet of film is stretched over said product, and disposed adjacent to said support table for folding other edges of said sheet of film under the product on the support surface, and means for advancing the product from the support surface to complete the folding of one edge of said sheet of film under the product.

35. Stretch wrap packaging apparatus comprising a product support surface for holding a product while it is being wrapped, a pivotable film support frame disposed adjacent to said product support surface, slidable film-clamping means slidably mounted on said frame, clamp moving means for moving said slidable film-clamping means into operative relation with the end of a length of stretch film to grasp said end of said length of stretch film and draw it across said frame, to load said frame with a length of film, means for pivoting said frame, while it is loaded with a length of film, to stretch said film over a product on said support surface, first folding means mounted on said frame and pivotable with said frame, said first folding means being operative while said film is stretched over said product to fold portions of said film under the product disposed on said support surface, second folding means, operative while said sheet of film is stretched over said product, and disposed adjacent to said support surface, for folding other portions of said film under the product on the support surface, and means for advancing the product from the support surface to an adjoining surface to complete the folding of said film under the product.

36. The apparatus defined in claim 35 wherein:

said film support frame substantially surrounds said product support surface when it has been pivoted to stretch the film over a product.

37. Stretch wrap packaging apparatus comprising a product support surface for holding a product while it is being wrapped, an outfeed conveyor disposed adjacent to said support surface for receiving a product from said support surface, a pivotable film support frame disposed adjacent to said support surface, slidable film-clamping means slidably mounted on said frame, clamp moving means for moving said slidable film-clamping means into operative relation with the end of a length of stretch film to grasp said end of said length of stretch film and draw it across said frame, means for pivoting said frame, while it is loaded with a length of film, to a position where it surrounds said product support surface, to stretch said length of film over a product on said support surface, folding means disposed adjacent to said support surface when said frame has been pivoted to surround said surface, said folding means being operative while said length of film is stretched over said product to fold portions of said film under the product disposed on said support surface, and means for advancing the product from the support surface to the output conveyor to complete the folding of said film under the product.

* * * * *